US007227401B2

(12) United States Patent
Zhang et al.

(10) Patent No.: US 7,227,401 B2
(45) Date of Patent: Jun. 5, 2007

(54) RESISTORLESS BIAS CURRENT GENERATION CIRCUIT

(75) Inventors: Weicheng Zhang, Xuzhou (CN); Seunghoon Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 101 days.

(21) Appl. No.: 11/225,587

(22) Filed: Aug. 31, 2005

(65) Prior Publication Data

US 2006/0103455 A1 May 18, 2006

(30) Foreign Application Priority Data

Nov. 15, 2004 (KR) ..... 10-2004-0093100

(51) Int. Cl.
*G05F 1/10* (2006.01)

(52) U.S. Cl. ..... 327/513; 327/538; 327/539

(58) Field of Classification Search ..... 327/512, 327/513, 535, 537, 538, 539, 540, 543
See application file for complete search history.

(56) References Cited

U.S. PATENT DOCUMENTS 5,880,625 A 3/1999 Park et al. ..... 327/543
6,107,868 A * 8/2000 Diniz et al. ..... 327/543
6,201,436 B1 3/2001 Hur et al. ..... 327/543
6,448,844 B1 * 9/2002 Cho ..... 327/538
7,026,860 B1 * 4/2006 Gheorghiu et al. ..... 327/513

FOREIGN PATENT DOCUMENTS

KR 183549 12/1998

* cited by examiner

*Primary Examiner*—Jeffrey Zweizig
(74) *Attorney, Agent, or Firm*—Mills & Onello LLP

(57) ABSTRACT

A bias current generating circuit generates a reliable and consistent bias current, irrespective of variation in applied power, process and temperature. In one embodiment, the bias current generator generates a bias current using a PTAT current generator and an IPTAT current generator comprising exclusively active circuit elements, for example transistors. No passive elements, such as resistors, are employed. The generated bias current is substantially a function of the respective aspect ratios of transistors of current paths of the device. In this manner, the resulting generated bias current has greatly reduced susceptibility to variation in applied power, process and temperature.

46 Claims, 3 Drawing Sheets

RESISTORLESS BIAS CURRENT GENERATION CIRCUIT

RELATED APPLICATIONS

This application claims priority under 35 U.S.C. 119 to Korean Patent Application No. 10-2004-0093100, filed on Nov. 15, 2004, the content of which is incorporated herein by reference in its entirety.

FIELD OF THE INVENTION

The present invention relates generally to an integrated circuit device, and more particularly, to a bias current generating circuit for an integrated circuit device.

BACKGROUND OF THE INVENTION

Bias current generating circuits are commonly employed in integrated circuit devices in order to generate a bias current from an external power supply voltage. An ideal bias current generating circuit generates a consistent bias current that is independent of variation in applied power, process parameters and temperature.

A conventional bias current generation circuit is disclosed in U.S. Pat. No. 6,201,436, the content of which is incorporated herein by reference. Such a circuit employs a first current generator in which a first generated current is proportional to absolute temperature (PTAT), or increases with increased temperature, and a second current generator in which a second generated current is inverse-proportional to absolute temperature (IPTAT), or decreases with increased temperature. The first and second generated currents are summed to generate a combined bias current with reduced susceptibility to variation in temperature and applied power.

In the conventional design, the PTAT and IPTAT current generators employ a resistor to generate the respective first and second currents. Since resistors are highly susceptible to process variation and operating temperature variation, the resulting bias current in the conventional approach is likewise susceptible to process and temperature variations.

SUMMARY OF THE INVENTION

The present invention is directed to a bias current generating circuit that generates a reliable and consistent bias current, irrespective of variation in applied power, process and temperature.

In particular, in one embodiment, the bias current generator of the present invention generates a bias current using a PTAT current generator and an IPTAT current generator comprising exclusively active circuit elements, for example transistors. No passive elements, such as resistors, are employed. The generated bias current is substantially a function of the respective aspect ratios of transistors of current paths of the device. In this manner, the resulting generated bias current has greatly reduced susceptibility to variation in applied power, process and temperature.

In one aspect, the present invention is directed to a bias current generator. The generator includes a proportional-to-absolute-temperature (PTAT) current generator comprising exclusively active circuit elements that generates a first current that is proportional to operating temperature. An inverse-proportional-to-absolute-temperature (IPTAT) current generator comprising exclusively active circuit elements generates a second current that is inversely proportional to the operating temperature. A summing circuit sums the first and second currents to generate a bias current.

In one embodiment, the bias current is generated substantially independent of the operating temperature.

In another embodiment, the PTAT current generator comprises: a PMOS cascode current mirror comprising: a first PMOS transistor and a second PMOS transistor connected in series between a first reference voltage and a first node, a gate of the first PMOS transistor being coupled to the first node and a gate of the second PMOS transistor being coupled to a first bias voltage; and a third PMOS transistor and a fourth PMOS transistor connected in series between the first reference voltage and a second node, a gate of the third PMOS transistor being coupled to the first node and a gate of the fourth PMOS transistor being coupled to the first bias voltage; an NMOS cascode current mirror comprising: a first NMOS transistor and a second NMOS transistor connected in series between the first node and a third node, a gate of the first NMOS transistor being coupled to a second bias voltage and a gate of the second NMOS transistor being coupled to the second node; and a third NMOS transistor and a fourth NMOS transistor connected in series between the second node and a fourth node, a gate of the third NMOS transistor being coupled to the second bias voltage and a gate of the fourth NMOS transistor being coupled to the second node; a first diode connected in series between the third node and a second reference voltage; and a second diode connected in series between the fourth node and the second reference voltage.

In another embodiment, the first reference voltage comprises a power supply voltage and the second reference voltage comprises a ground voltage.

In another embodiment, the first diode comprises a PNP-type bipolar junction transistor, an emitter of which is connected to the third node and a base and collector of which are connected to the second reference voltage and wherein the second diode comprises a PNP-type bipolar junction transistor, an emitter of which is connected to the fourth node and a base and collector of which are connected to the second reference voltage.

In another embodiment, the first bias voltage is at a voltage level that is sufficient to saturate the second and fourth PMOS transistors, and wherein the second bias voltage is at a voltage level that is sufficient to saturate the first and third NMOS transistors.

In another embodiment, the IPTAT current generator comprises: a fifth PMOS transistor and a sixth PMOS transistor connected in series between the first reference voltage and a fifth node, a gate of the fifth PMOS transistor being coupled to the first node and a gate of the sixth PMOS transistor being coupled to the first bias voltage; and a fifth NMOS transistor and a sixth NMOS transistor connected in series between the fifth node and the second reference voltage, the fifth and sixth NMOS transistors each being configured in a diode configuration; a seventh PMOS transistor connected between the first reference voltage and a sixth node, the gate of the seventh PMOS transistor being coupled to the sixth node; and a seventh NMOS transistor and an eighth NMOS transistor connected in series between the sixth node and the second reference voltage, a gate of the seventh NMOS transistor being coupled to the second node, and a gate of the eighth NMOS transistor being coupled to the fifth node.

In another embodiment, the summing circuit comprises: an eighth PMOS transistor and a ninth PMOS transistor connected in series between the first reference voltage and a seventh node, a gate of the eighth PMOS transistor being coupled to the first node and a gate of the ninth PMOS transistor being coupled to the first bias voltage; a tenth PMOS transistor connected between the first reference voltage and the seventh node, a gate of the tenth PMOS transistor being coupled to the sixth node; a ninth NMOS transistor connected between the seventh node and the second reference voltage, the gate of the ninth NMOS transistor being coupled to the seventh node; and a tenth NMOS transistor connected between a bias node at which the bias current is drawn and the second reference voltage, the gate of the tenth NMOS transistor being coupled to the seventh node.

In another embodiment, the bias current generator further comprises a bias voltage generator including a first bias voltage generator that generates the first bias voltage and a second bias voltage generator that generates the second bias voltage. The first bias voltage generator comprises: an eleventh PMOS transistor and an eleventh NMOS transistor in series between the first reference voltage and the second reference voltage, the gate of the eleventh PMOS transistor being coupled to the first node, the gate of the eleventh NMOS transistor being coupled to a junction between the eleventh PMOS transistor and the eleventh NMOS transistor; a twelfth PMOS transistor and a twelfth NMOS transistor in series between the first reference voltage and the second reference voltage, the gate of the twelfth PMOS transistor being coupled to a junction between the twelfth PMOS transistor and the twelfth NMOS transistor, the gate of the twelfth NMOS transistor being coupled to the gate of the eleventh NMOS transistor; and a thirteenth PMOS transistor, a fourteenth PMOS transistor and a thirteenth NMOS transistor in series between the first reference voltage and the second reference voltage, the gate of the thirteenth PMOS transistor being coupled to the gate of the twelfth PMOS transistor, the gate of the fourteenth PMOS transistor being coupled to a junction between the fourteenth PMOS transistor and the thirteenth NMOS transistor, the gate of the thirteenth NMOS transistor being coupled to the gate of the twelfth NMOS transistor, wherein the junction of the fourteenth PMOS transistor and the thirteenth NMOS transistor provides the first bias voltage. The second bias voltage generator comprises: a fifteenth PMOS transistor and a fifteenth NMOS transistor in series between the first reference voltage and an eighth node, the gate of the fifteenth PMOS transistor being coupled to the first node, the gate of the fifteenth NMOS transistor being coupled to a junction between the fifteenth PMOS transistor and the fifteenth NMOS transistor; a sixteenth PMOS transistor, a fourteenth NMOS transistor and a sixteenth NMOS transistor in series between the first reference voltage and the eighth node, the gate of the sixteenth PMOS transistor being coupled to the first node, the gate of the fourteenth NMOS transistor being coupled to a junction between the sixteenth PMOS transistor and the fourteenth NMOS transistor, the gate of the sixteenth NMOS transistor being coupled to the gate of the fifteenth NMOS transistor; and a third diode connected in series between the eighth node and the second reference voltage, wherein the junction of the sixteenth PMOS transistor and the fourteenth NMOS transistor provides the second bias voltage.

In another embodiment, the third diode comprises a PNP-type bipolar junction transistor, an emitter of which is connected to the eighth node and a base and collector of which are connected to the second reference voltage.

In another embodiment, the bias current generator further comprises a start-up circuit that ensures that transistors in the PTAT current generator and the IPTAT current generator initialize beyond a degenerate bias.

In another embodiment, the start-up circuit comprises: a seventeenth PMOS transistor, an eighteenth PMOS transistor, a nineteenth NMOS transistor and a twentieth NMOS transistor connected in series between the first reference voltage and the second reference voltage, gates of the seventeenth and eighteenth PMOS transistors each being coupled to the second reference voltage, a gate of the nineteenth NMOS transistor being coupled to the second bias voltage and a gate of the twentieth NMOS transistor being coupled to the second node; a seventeenth NMOS transistor connected in series between the first node and the second reference voltage; and an eighteenth NMOS transistor connected in series between the first bias voltage and the second reference voltage.

In another embodiment, the summing circuit comprises: a first current mirror that generates a first mirrored current in response to the first current generated by the PTAT;. a second current mirror that generates a second mirrored current in response to the second current generated by the PTAT; and a third current mirror that generates the bias current based on the sum of the first mirrored current and the second mirrored current.

In another embodiment, the first current is generated further as a function of a first aspect ratio of at least one transistor along a first current path relative to a second aspect ratio of at least one transistor along a second current path, the second current path and first current path being in a current mirror configuration, the first and second aspect ratios for corresponding transistors in the first and second current paths being different.

In another embodiment, the second current is generated further as a function of a voltage generated in the PTAT current generator that is divided by an active circuit element in the IPTAT current generator to generate the second current.

In another embodiment, the PTAT current generator comprises: a first current path comprising a plurality of transistors; and a second current path comprising a plurality of transistors, at least one of the plurality of transistors of the second current path corresponding to one of the plurality of transistors of the first current path, at least one pair of the corresponding transistors of the first and second current paths having a different aspect ratio, wherein the first current is generated in response to the different aspect ratio of the corresponding transistors of the first and second current paths.

In another embodiment, the IPTAT current generator comprises: a third current path comprising a plurality of transistors, wherein the second current is generated as a function of a voltage generated in the PTAT current generator that is divided by a transistor in the third current path to generate the second current.

In another embodiment, the PTAT current generator comprises: a first diode connected in series between a first reference voltage and a third node; a second diode connected in series between the first reference voltage and a fourth node; a PMOS cascode current mirror comprising: a first PMOS transistor and a second PMOS transistor connected in series between the third node and a first node, and a third PMOS transistor and a fourth PMOS transistor connected in series between the fourth node and a second node, gates of the first and third PMOS transistors being coupled to the second node, and gates of the second and fourth PMOS transistors being coupled to a first bias voltage; and an NMOS cascode current mirror comprising: a first NMOS transistor and a second NMOS transistor connected in series between the first node and a second reference voltage, and a third NMOS transistor and a fourth NMOS transistor connected in series between the second node and the second reference voltage, gates of the first and third NMOS transistors being coupled to a second bias voltage, and gates of the second and fourth NMOS transistors being coupled to the first node.

In another embodiment, the first reference voltage comprises a power supply voltage and the second reference voltage comprises a ground voltage.

In another embodiment, the first diode comprises an NPN-type bipolar junction transistor, an emitter of which is connected to the third node and a base and collector of which are connected to the first reference voltage and wherein the second diode comprises an NPN-type bipolar junction transistor, an emitter of which is connected to the fourth node and a base and collector of which are connected to the first reference voltage.

In another embodiment, the first bias voltage is at a voltage level that is sufficient to saturate the second and fourth PMOS transistors, and wherein the second bias voltage is at a voltage level that is sufficient to saturate the first and third NMOS transistors.

In another embodiment, the IPTAT current generator comprises: a fifth PMOS transistor and a sixth PMOS transistor connected in series between the first reference voltage and a fifth node, the fifth and sixth PMOS transistors each being configured in a diode configuration; and a fifth NMOS transistor and a sixth NMOS transistor connected in series between the fifth node and the second reference voltage, a gate of the fifth NMOS transistor being coupled to the second bias voltage and a gate of the sixth NMOS transistor being coupled to the first node; a seventh PMOS transistor and an eighth PMOS transistor connected in series between the first reference voltage and a sixth node, a gate of the seventh PMOS transistor being coupled to the fifth node, and a gate of the eighth PMOS transistor being coupled to the second node; and a seventh NMOS transistor connected between the sixth node and the second reference voltage, the gate of the seventh NMOS transistor being coupled to the sixth node.

In another embodiment, the summing circuit comprises: an eighth NMOS transistor and a ninth NMOS transistor connected in series between a seventh node and the second reference voltage, a gate of the eighth NMOS transistor being coupled to the second bias voltage and a gate of the ninth NMOS transistor being coupled to the first node; a tenth NMOS transistor connected between the seventh node and the second reference voltage, a gate of the tenth NMOS transistor being coupled to the sixth node; and a ninth PMOS transistor connected between the first reference voltage and the seventh node, the gate of the ninth PMOS transistor being coupled to the seventh node; and a tenth PMOS transistor connected between the first reference voltage and a bias node at which the bias current is drawn, the gate of the tenth NMOS transistor being coupled to the seventh node.

In another aspect, the present invention is directed to a bias current generator. A proportional-to-absolute-temperature (PTAT) current generator generates a first current that is proportional to operating temperature. The PTAT current generator comprises a first current path comprising a plurality of transistors; and a second current path comprising a plurality of transistors, at least one of the plurality of transistors of the second current path corresponding to one of the plurality of transistors of the first current path, at least one pair of the corresponding transistors of the first and second current paths having a different aspect ratio, wherein the first current is generated in response to the different aspect ratio of the corresponding transistors of the first and second current paths. An inverse-proportional-to-absolute-temperature (IPTAT) current generator generates a second current that is inversely proportional to the operating temperature. The IPTAT current generator comprises a third current path comprising a plurality of transistors. The second current is generated as a function of a voltage generated in the PTAT current generator that is divided by a transistor in the third current path to generate the second current. A summing circuit sums the first and second currents to generate a bias current.

In one embodiment, the PTAT current generator comprises exclusively active circuit elements.

In another embodiment, the IPTAT current generator comprises exclusively active circuit elements.

In another embodiment, the bias current is generated substantially independent of the operating temperature.

In another embodiment, the PTAT current generator comprises: a PMOS cascode current mirror comprising: a first PMOS transistor and a second PMOS transistor connected in series between a first reference voltage and a first node, a gate of the first PMOS transistor being coupled to the first node and a gate of the second PMOS transistor being coupled to a first bias voltage; and a third PMOS transistor and a fourth PMOS transistor connected in series between the first reference voltage and a second node, a gate of the third PMOS transistor being coupled to the first node and a gate of the fourth PMOS transistor being coupled to the first bias voltage; an NMOS cascode current mirror comprising: a first NMOS transistor and a second NMOS transistor connected in series between the first node and a third node, a gate of the first NMOS transistor being coupled to a second bias voltage and a gate of the second NMOS transistor being coupled to the second node; and a third NMOS transistor and a fourth NMOS transistor connected in series between the second node and a fourth node, a gate of the third NMOS transistor being coupled to the second bias voltage and a gate of the fourth NMOS transistor being coupled to the second node; a first diode connected in series between the third node and a second reference voltage; and a second diode connected in series between the fourth node and the second reference voltage.

In another embodiment, the first reference voltage comprises a power supply voltage and the second reference voltage comprises a ground voltage.

In another embodiment, the first diode comprises a PNP-type bipolar junction transistor, an emitter of which is connected to the third node and a base and collector of which are connected to the second reference voltage and wherein the second diode comprises a PNP-type bipolar junction transistor, an emitter of which is connected to the fourth node and a base and collector of which are connected to the second reference voltage.

In another embodiment, the first bias voltage is at a voltage level that is sufficient to saturate the second and fourth PMOS transistors, and wherein the second bias voltage is at a voltage level that is sufficient to saturate the first and third NMOS transistors.

In another embodiment, the IPTAT current generator comprises: a fifth PMOS transistor and a sixth PMOS transistor connected in series between the first reference voltage and a fifth node, a gate of the fifth PMOS transistor being coupled to the first node and a gate of the sixth PMOS transistor being coupled to the first bias voltage; and a fifth NMOS transistor and a sixth NMOS transistor connected in series between the fifth node and the second reference voltage, the fifth and sixth NMOS transistors each being configured in a diode configuration; a seventh PMOS transistor connected between the first reference voltage and a sixth node, the gate of the seventh PMOS transistor being coupled to the sixth node; and a seventh NMOS transistor and an eighth NMOS transistor connected in series between the sixth node and the second reference voltage, a gate of the seventh NMOS transistor being coupled to the second node, and a gate of the eighth NMOS transistor being coupled to the fifth node.

In another embodiment, the summing circuit comprises: an eighth PMOS transistor and a ninth PMOS transistor connected in series between the first reference voltage and a seventh node, a gate of the eighth PMOS transistor being coupled to the first node and a gate of the ninth PMOS transistor being coupled to the first bias voltage; a tenth PMOS transistor connected between the first reference voltage and the seventh node, a gate of the tenth PMOS transistor being coupled to the sixth node; a ninth NMOS transistor connected between the seventh node and the second reference voltage, the gate of the ninth NMOS transistor being coupled to the seventh node; and a tenth NMOS transistor connected between a bias node at which the bias current is drawn and the second reference voltage, the gate of the tenth NMOS transistor being coupled to the seventh node.

In another embodiment, the bias current generator further comprises a bias voltage generator including a first bias voltage generator that generates the first bias voltage and a second bias voltage generator that generates the second bias voltage. The first bias voltage generator comprises: an eleventh PMOS transistor and an eleventh NMOS transistor in series between the first reference voltage and the second reference voltage, the gate of the eleventh PMOS transistor being coupled to the first node, the gate of the eleventh NMOS transistor being coupled to a junction between the eleventh PMOS transistor and the eleventh NMOS transistor; a twelfth PMOS transistor and a twelfth NMOS transistor in series between the first reference voltage and the second reference voltage, the gate of the twelfth PMOS transistor being coupled to a junction between the twelfth PMOS transistor and the twelfth NMOS transistor, the gate of the twelfth NMOS transistor being coupled to the gate of the eleventh NMOS transistor; and a thirteenth PMOS transistor, a fourteenth PMOS transistor and a thirteenth NMOS transistor in series between the first reference voltage and the second reference voltage, the gate of the thirteenth PMOS transistor being coupled to the gate of the twelfth PMOS transistor, the gate of the fourteenth PMOS transistor being coupled to a junction between the fourteenth PMOS transistor and the thirteenth NMOS transistor, the gate of the thirteenth NMOS transistor being coupled to the gate of the twelfth NMOS transistor, wherein the junction of the fourteenth PMOS transistor and the thirteenth NMOS transistor provides the first bias voltage. The second bias voltage generator comprises: a fifteenth PMOS transistor and a fifteenth NMOS transistor in series between the first reference voltage and an eighth node, the gate of the fifteenth PMOS transistor being coupled to the first node, the gate of the fifteenth NMOS transistor being coupled to a junction between the fifteenth PMOS transistor and the fifteenth NMOS transistor; a sixteenth PMOS transistor, a fourteenth NMOS transistor and a sixteenth NMOS transistor in series between the first reference voltage and the eighth node, the gate of the sixteenth PMOS transistor being coupled to the first node, the gate of the fourteenth NMOS transistor being coupled to a junction between the sixteenth PMOS transistor and the fourteenth NMOS transistor, the gate of the sixteenth NMOS transistor being coupled to the gate of the fifteenth NMOS transistor; and a third diode connected in series between the eighth node and the second reference voltage, wherein the junction of the sixteenth PMOS transistor and the fourteenth NMOS transistor provides the second bias voltage.

In another embodiment, the third diode comprises a PNP-type bipolar junction transistor, an emitter of which is connected to the eighth node and a base and collector of which are connected to the second reference voltage.

In another embodiment, the bias current generator further comprises a start-up circuit that ensures that transistors in the PTAT current generator and the IPTAT current generator initialize beyond a degenerate bias.

In another embodiment, the start-up circuit comprises: a seventeenth PMOS transistor, an eighteenth PMOS transistor, a nineteenth NMOS transistor and a twentieth NMOS transistor connected in series between the first reference voltage and the second reference voltage, gates of the seventeenth and eighteenth PMOS transistors each being coupled to the second reference voltage, a gate of the nineteenth NMOS transistor being coupled to the second bias voltage and a gate of the twentieth NMOS transistor being coupled to the second node; a seventeenth NMOS transistor connected in series between the first node and the second reference voltage; and an eighteenth NMOS transistor connected in series between the first bias voltage and the second reference voltage.

In another embodiment, the summing circuit comprises: a first current mirror that generates a first mirrored current in response to the first current generated by the PTAT; a second current mirror that generates a second mirrored current in response to the second current generated by the PTAT; and a third current mirror that generates the bias current based on the sum of the first mirrored current and the second mirrored current.

In another embodiment, the first current is generated further as a function of a first aspect ratio of at least one transistor along a first current path relative to a second aspect ratio of at least one transistor along a second current path, the second current path and first current path being in a current mirror configuration, the first and second aspect ratios for corresponding transistors in the first and second current paths being different.

In another embodiment, the second current is generated further as a function of a voltage generated in the PTAT current generator that is divided by an active circuit element in the IPTAT current generator to generate the second current.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF PREFERRED EMBODIMENTS

Figure 1:
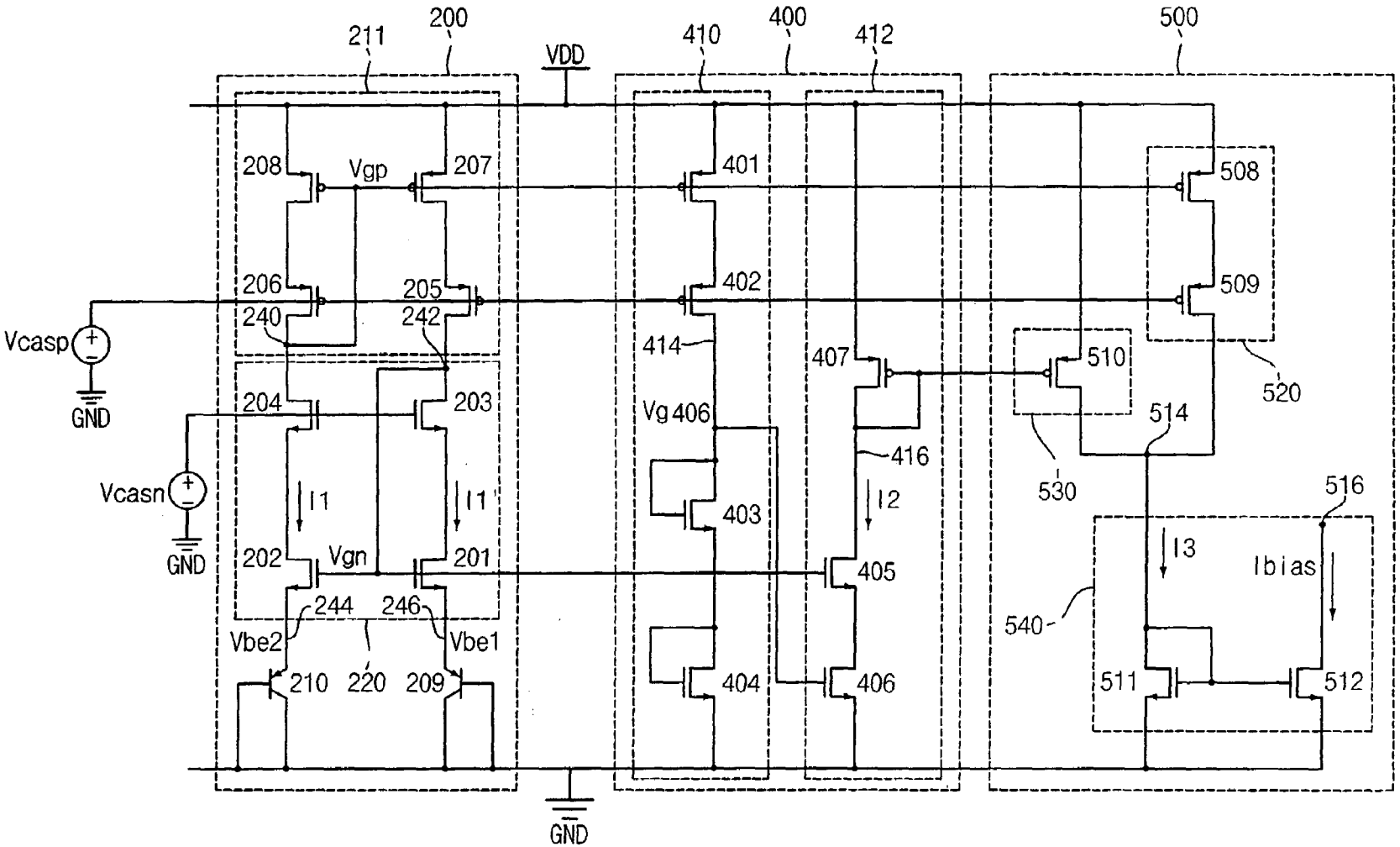
FIG. 1 is a circuit diagram of a first embodiment of a bias current generating circuit in accordance with the present invention.

FIG. 1 is a circuit diagram of a first embodiment of a bias current generating circuit in accordance with the present invention. With reference to FIG. 1, the bias generating circuit includes a proportional-to-absolute-temperature (PTAT) current generator 200, an inverse-proportional-to-absolute-temperature (IPTAT) current generator 400, and a summing circuit 500.

In one embodiment, the PTAT current generator 200 and the IPTAT current generator 400 employ exclusively active elements, such as NMOS and PMOS transistors and bipolar junction transistors, and therefore do not include passive elements, such as resistors. The PTAT current generator 200 generates a first sub-current $I_1$ that is proportional to temperature. The IPTAT current generator 400 generates a second sub-current $I_2$ that is inverse-proportional to temperature. The summing circuit 500 sums the first sub-current $I_1$ and the second sub-current $I_2$ to generate a sum current $I_3$ that is used to generate a bias current $I_{bias}$. Since the PTAT current generator 200 and the IPTAT current generator 400 do not employ passive elements such as resistors, the bias current generating circuit of FIG. 1 has near insusceptibility to variation in process, applied voltage, and temperature.

In this embodiment, the PTAT current generator 200 includes a PMOS cascode current mirror 211, an NMOS cascode current mirror 220, and first and second PNP-type bipolar junction transistors 210, 209.

The PMOS cascode current mirror 211 includes a first PMOS transistor 208 and a second PMOS transistor 206 coupled in series between a first reference voltage VDD and a first node 240. The PMOS cascode current mirror 211 further includes a third PMOS transistor 207 and a fourth PMOS transistor 205 coupled in series between the first reference voltage VDD and a second node 242. Gates of the first PMOS transistor 208 and the third PMOS transistor 207 are coupled to the first node 240. Gates of the second PMOS transistor 206 and the fourth PMOS transistor 205 are coupled to a first bias voltage Vcasp.

The NMOS cascode current mirror 220 includes a first NMOS transistor 204 and a second NMOS transistor 202 coupled in series between the first node 240 and a third node 244. The NMOS cascode current mirror 220 further includes a third NMOS transistor 203 and a fourth NMOS transistor 201 coupled in series between the second node 242 and a fourth node 246. Gates of the first NMOS transistor 204 and the third NMOS transistor 203 are coupled to a second bias voltage Vcasn. Gates of the second NMOS transistor 202 and the fourth NMOS transistor 201 are coupled to the second node 242.

A first bipolar junction transistor 210 is coupled in a diode configuration between the third node 244 and a second reference voltage GND. The base of the first bipolar junction transistor 210 is coupled to the second reference voltage GND. A second bipolar junction transistor 209 is coupled in a diode configuration between the fourth node 246 and the second reference voltage GND. The base of the second bipolar junction transistor 209 is coupled to the second reference voltage GND.

By virtue of the operation of the current mirror configuration, the first sub-current $I_1$, flowing through the first and second PMOS transistors 208 and 206 and the first and second NMOS transistors 204 and 202 is equal to the first mirror sub-current $I_1'$ flowing through the third and fourth PMOS transistors 207 and 205 and the third and fourth NMOS transistors 203 and 201. According to the circuit configuration, the gate voltages of the third and fourth NMOS transistors 202, 201 are the same, therefore:

$$V_{be1}+V_{gs201}=V_{be2}+V_{gs202} \tag{1}$$

where the voltage at the fourth node, $V_{be1}$, is the base-emitter voltage of the second bipolar junction transistor 209, $V_{gs201}$ is the gate-source voltage of the fourth NMOS transistor 201, the voltage at the third node, $V_{be2}$, is the base-emitter voltage of the first bipolar junction transistor 210, and $V_{gs202}$ is the gate-source voltage of the third NMOS transistor 202.

Since the base-emitter voltage of a bipolar junction transistor can be represented as:

$$V_{be} = V_T \cdot \ln\frac{I_C}{I_S} \tag{2}$$

where $V_T$ represents thermal voltage), $I_C$ is the collector current through the transistor and $I_S$ is the bipolar junction transistor saturation current, and since the gate-source voltage of a MOS transistor can be represented as:

$$V_{gs} = \sqrt{\frac{2I_D}{\mu_n C_{ox}(W/L)}} + V_{th} \tag{3}$$

where $I_D$ is drain current), $\mu_n$ is electron mobility, $C_{ox}$ is the gate unit capacitance, W/L is the aspect ratio of the transistor and $V_{th}$ is the transistor threshold voltage, then, ignoring the base current, equations (2) and (3) above can be substituted into equation (1) above to give:

$$V_T \cdot \ln\frac{I_1'}{I_{S209}} + \sqrt{\frac{2I_1'}{\mu_n C_{ox}(W/L)_{201}}} + V_{th201} = V_T \cdot \ln\frac{I_1}{I_{S210}} + \sqrt{\frac{2I_1}{\mu_n C_{ox}(W/L)_{202}}} + V_{th202} \tag{4}$$

If the transistor body effect is considered negligible, and the threshold voltage of the fourth NMOS transistor is assumed to be equal to the threshold voltage of the third NMOS transistor, $V_{th201}=V_{th202}$, and the first sub-current $I_1$ is considered equal to the first mirrored sub current $I_1'$, $I_1=I_1'$, then equation (4) can be rewritten as:

$$V_T \cdot \ln\frac{I_{S210}}{I_{S209}} = \sqrt{\frac{2I_1}{\mu_n C_{ox}(W/L)_{201}}}\left(\sqrt{\frac{(W/L)_{201}}{(W/L)_{202}}} - 1\right) \tag{5}$$

With respect to current $I_1$:

$$I_1 = \frac{\mu_n C_{ox}(W/L)_{201}\left(\frac{kT}{q}\cdot \ln m\right)^2}{2\left(\sqrt{n}-1\right)^2} \tag{6}$$

where k is the Boltzman constant, T is absolute temperature, $m=I_{S210}/I_{S209}$, q is the electron charge value and $n=(W/L)_{201}/(W/L)_{202}$. The parameter $\mu_n C_{ox}$ is proportional to $T^{-1.5}$, so the first sub-current $I_1$ is proportional to $T^{0.5}$, $I_1 \propto T^{0.5}$, and especially in the operational range of the bias circuit, namely in the industrial temperature range between −55C and 125C, the proportional rate is linear. In one embodiment, both m and n are chosen to be greater than 1 and, in one example, n=2 and m=7.

The gate voltage $V_{gn}$ of the fourth NMOS transistor 201 is used to generate the second sub-current $I_2$ at the IPTAT current generator 400, and can be represented as the sum of the base-emitter voltage of the second bipolar junction transistor 209, $V_{be1}$, and the gate-to-source voltage of the fourth NMOS transistor 201, $V_{gs201}$. Substituting equation (3) above provides:

$$\begin{aligned} V_{gn} &= V_{be1} + V_{gs201} \\ &= V_{be1} + \sqrt{\frac{2I_1}{\mu_n C_{ox}(W/L)_{201}}} + V_{th} \\ &= V_{be1} + V_{th} + \frac{kT}{q}\cdot\frac{\ln m}{\sqrt{n}-1} \end{aligned} \tag{7}$$

Returning to equation (2), and differentiating $V_{be1}$ with respect to absolute temperature T provides:

$$\frac{\partial V_{be1}}{\partial T} = \frac{\partial V_T}{\partial T}\ln I_{C209} + \frac{V_T}{I_{C209}}\frac{\partial I_{C209}}{\partial T} - \frac{\partial V_T}{\partial T}\ln I_{S209} - \frac{V_T}{I_{S209}}\frac{\partial I_{S209}}{\partial T} \tag{8}$$

If the base current of the second bipolar junction transistor 209 is considered negligible, and ignored, then the current flowing through the second bipolar junction transistor $I_{c209}$ is substantially the same as the first sub-current $I_1$. Since the first sub-current $I_1$ is proportional to $T^{0.5}$, then:

$$I_{C209}=c\cdot T^{0.5} \tag{9}$$

where c represents a proportional constant, and T is absolute temperature.

The saturation current of the second bipolar junction transistor 209, $I_{S209}$ can be represented as:

$$I_{S209}=b\cdot T^{2.5}e^{-E_g/kT} \tag{10}$$

where b represents a proportional constant and $E_g$ is the bandgap energy of silicon, or 1.12 eV.

From equations (9) and (10), it can be derived that:

$$\frac{\partial V_T}{\partial T}\ln I_{C209} = \frac{V_T}{T}\ln I_{C209} \tag{11}$$

$$\frac{V_T}{I_{C209}}\frac{\partial I_{C209}}{\partial T} = \frac{V_T}{cT^{0.5}}\cdot\frac{1}{2}cT^{-0.5} = \frac{V_T/2}{T} \tag{12}$$

-continued $$\frac{\partial V_T}{\partial T}\ln I_{S209} = \frac{V_T}{T}\ln I_{S209} \tag{13}$$

$$\frac{V_T}{I_{S209}}\frac{\partial I_{S209}}{\partial T} = \frac{5}{2}\frac{V_T}{T} + \frac{E_g}{kT^2}V_T = \frac{2.5V_T}{T} + \frac{E_g/q}{T} \tag{14}$$

Substituting equations (11)–(14) into equation (8) provides for the temperature coefficient of the base-emitter voltage of the second bipolar junction transistor 209, or the temperature coefficient of $V_{be1}$:

$$\begin{aligned} \frac{\partial V_{be1}}{\partial T} &= \frac{V_T}{T}\ln I_{C209} + \frac{V_T/2}{T} - \frac{V_T}{T}\ln I_{S209} - \frac{2.5V_T}{T} - \frac{E_g/q}{T} \\ &= \frac{V_{be1} - 2V_T - E_g/q}{T} \end{aligned} \tag{15}$$

In one example, the base-emitter voltage of the second bipolar junction transistor $V_{be1}$=0.8V, the thermal voltage $V_T$=26 mV, the parameter Eg/q=1.12V, and the absolute operating temperature T=300K. In this case, the resulting temperature coefficient of the base-emitter voltage of the second bipolar junction transistor is equal to −1.2 mV/C.

Returning to equation (7), the temperature coefficient of the first term of the equation is −1.2 mV/C, the temperature coefficient of the second term of the equation is −2.5 mV/C, and the temperature coefficient of the third term of the equation is 0.4 mV/C. The stated coefficients are typical values, and can change from process to process.

In view of the above, it can be concluded that the gate voltage of the fourth NMOS transistor 201, $V_{gn201}$, is inversely proportional to temperature, and especially in the industrial operating range of −55 C to 125 C, $V_{gn}$ is proportionally reduced, in other words, $V_{gn}$ decreases with increasing temperature.

Although the third term of equation (7) increases with temperature, for typical values of m and n (for example, m=7 and n=2), the slope of this term is 0.4 mV/C. Therefore, as temperature rises, the combined decrease of the first two terms dominates over the increase of the third term in equation (7). Thus, the net effect is that gate voltage of the fourth NMOS transistor $V_{gn201}$ approximately decreases linearly with increasing temperature in the temperature range of interest. Therefore, the PTAT current generator circuit 200 generates both a first sub-current $I_1$ and a voltage $V_{gn}$ that decrease with temperature. This voltage $V_{gn}$ is used to generate the IPTAT current, as described below. Since no integrated resistors are used in the PTAT current generator 200, the generated first sub-current $I_1$ is not sensitive to process variations.

The IPTAT current generator 400 includes a control voltage supply 410 and a second sub-current generator 412.

The control voltage supply 410 includes a fifth PMOS transistor 401 and a sixth PMOS transistor 402 coupled in series between the first reference voltage VDD and a fifth node 414. The gate of the fifth PMOS transistor is coupled to the first node 240 and the gate of the sixth PMOS transistor is coupled to the first bias voltage Vcasp. The control voltage supply 410 further includes a fifth NMOS transistor 403 and a sixth NMOS transistor 404 coupled in series between the fifth node 414 and the second reference voltage GND. The gates of the fifth NMOS transistor 403 and the sixth NMOS transistor 404 are coupled to their sources, so that the fifth and sixth NMOS transistors 403, 404 are diode-connected and therefore operate as diodes.

The second sub-current generator 412 of the IPTAT current generator 400 includes a seventh PMOS transistor 407 coupled in series between the first reference voltage VDD and a sixth node 416. The gate of the seventh PMOS transistor 407 is coupled to the sixth node 416. The second sub-current generator 412 of the IPTAT current generator 400 further includes a seventh NMOS transistor 405 and an eighth NMOS transistor 406 coupled in series between the sixth node 416 and the second reference voltage GND. The gate of the seventh NMOS transistor 405 is coupled to the second node 242 at the gate of the fourth NMOS transistor $V_{gn201}$, and the gate of the eighth NMOS transistor 406 is coupled to the fifth node 414.

The control voltage supplier 410 operates to ensure that the voltage supplied by the fifth node 414 to the gate of the eighth NMOS transistor 406, $V_{g406}$, causes the eighth NMOS transistor to operate in the linear region. By ensuring operation of the eighth NMOS transistor 406 in the linear region, the eighth NMOS transistor operates in the same manner that a resistor operates.

As described above, the voltage at the gate of the fourth NMOS transistor $V_{gn201}$ is inversely proportional to operating temperature. Since that voltage is applied to the gate of the seventh NMOS transistor 405, the second sub-current $I_2$ is generated to be inversely proportional to the operating temperature.

The drain current $I_2$ of the eighth NMOS transistor 406 can be represented as:

$$I_2 = \frac{1}{1/g_{m405} + r_{ds406}} \cdot V_{gn} \approx \frac{V_{gn}}{r_{ds406}} \tag{16}$$

where $g_{m405}$ is the transconductance of the seventh NMOS transistor 405, $V_{gn}$ is the gate voltage of the eighth NMOS transistor 406, $V_{g406}$, and $r_{ds406}$ is the drain-source resistance of the eighth NMOS transistor 406. The approximation of equation (16) holds true if $r_{ds406} >> 1/g_{m405}$, which can be achieved by providing the eighth NMOS transistor 406 with a relatively small aspect ratio (W/L ratio).

The resistance of the eighth NMOS transistor 406, $r_{ds406}$, can be expressed as:

$$r_{ds406} = \frac{1}{\mu_n C_{ox}(W/L)_{406}(V_{g406} - V_{th})} \tag{17}$$

The gate voltage of the NMOS transistor 406, $V_{g406}$, can be represented as:

$$V_{g406} = V_{gs404} + V_{gs403} = \sqrt{\frac{2I_{D404}}{\mu_n C_{ox}(W/L)_{404}}} + V_{th} + \sqrt{\frac{2I_{D403}}{\mu_n C_{ox}(W/L)_{403}}} + V_{th} = \frac{\sqrt{2I_1(W/L)_{401}/(W/L)_{208}}}{\mu_n C_{ox}(W/L)_{404}} + \frac{\sqrt{2I_1(W/L)_{401}/(W/L)_{208}}}{\mu_n C_{ox}(W/L)_{403}} + \tag{18}$$

-continued $$2V_{th} = \sqrt{\frac{\frac{2(W/L)_{401}}{(W/L)_{208}}}{\mu_n C_{ox}(W/L)_{404}} \frac{\mu_n C_{ox}(W/L)_{201}\left(\frac{kT}{g}\ln m\right)^2}{2(\sqrt{n}-1)^2}} + \sqrt{\frac{2\frac{(W/L)_{401}}{(W/L)_{208}}}{\mu_n C_{ox}(W/L)_{403}} \frac{\mu_n C_{ox}(W/L)_{201}\left(\frac{kT}{g}\ln m\right)^2}{2(\sqrt{n}-1)^2}} + 2V_{th} = \frac{kT}{q} \cdot \frac{\ln m}{\sqrt{n}-1}\left(\sqrt{\frac{(W/L)_{401}(W/L)_{201}}{(W/L)_{208}(W/L)_{404}}} + \sqrt{\frac{(W/L)_{401}(W/L)_{201}}{(W/L)_{208}(W/L)_{403}}} + \right) + 2V_{th}$$

where $m = I_{S210}/I_{S209}$ and where $n = (W/L)_{201}/(W/L)_{202}$, from equation (6) above, and where the body effect of the fifth NMOS transistor is considered negligible.

Now, substituting equation (18) into equation (17), provides another expression for the resistance of the eighth NMOS transistor 406, $r_{ds406}$:

$$r_{ds406} = \frac{1}{\mu_n C_{ox}(W/L)_{406}\left[\frac{kT}{q} \cdot \frac{\ln m}{\sqrt{n}-1}\left(\sqrt{\frac{(W/L)_{401}(W/L)_{201}}{(W/L)_{208}(W/L)_{404}}} + \sqrt{\frac{(W/L)_{401}(W/L)_{201}}{(W/L)_{208}(W/L)_{403}}}\right) + V_{th}\right]} \tag{19}$$

It can be seen in this representation that the first term of the bracket in the denominator is proportional to temperature and the second term of the bracket in the denominator, or $V_{th}$, is inversely proportional to temperature, which is a known property of MOSFET devices. In this manner, the effective resistance of the eighth NMOS transistor 406, $r_{ds406}$, is made to be independent of temperature, the resistance value $r_{ds406}$ being exclusively controlled according to the aspect ratio (W/L), or the ratio of channel width W to channel length L, of the fifth PMOS transistor 401, the fifth NMOS transistor 403, the sixth NMOS transistor 404 and the eighth NMOS transistor 406, the fourth NMOS transistor 201, and the first PMOS transistor 208. By controlling the aspect ratios in this manner, the eighth NMOS transistor can be made to operate as a resistor, while not being subject to temperature-dependence. Therefore, the IPTAT 400 including the eighth NMOS transistor 406 can be made to generate a second sub-current $I_2$ that is inversely proportional to temperature, since the gate voltage of the eighth NMOS transistor 406, $V_{g406}$, is inversely proportional to temperature, while not being subject to temperature-dependent operation. This assumes that the effect of $\mu_n$ in equation (19) is not considered. If this effect is considered, $\mu_n \alpha T^{1.5}$ as mentioned previously, and $r_{ds406}$ increases with temperature. Returning to equation (16), as temperature increases, the numerator ($V_{gn}$) decreases, while the denominator increases. Therefore, in this manner, the second sub-current $I_2$ decreases with temperature. Resistors are highly sensitive to process variation and are also temperature-dependent. Therefore, by eliminating resistors in the present configuration, sensitivity to process variation and temperature dependence in greatly reduced.

During operation, the first bias voltage $V_{casp}$ and the second bias voltage $V_{casn}$ ensure that the PMOS transistors 205, 206, and 402 and the NMOS transistors 203, 204 respectively operate in the saturation region. In addition, in one embodiment, the respective aspect ratios of the first and third PMOS transistors 208, 207, the second and fourth NMOS transistors 206, 205, and the first and third PMOS transistors 204, 203 are the same. This is because $I_1=I_1'$ in the PTAT current generator circuit 200.

The transistors having different aspect ratios are the fourth and second NMOS transistors 201, 202 and the second and first bipolar junction transistors 209, 210. This ensures that m and n of equation (6) are not 1. If m and n are 1, equation (6) will no longer hold true.

The summing circuit 500 includes a first summing circuit current mirror 520, a second summing circuit current mirror 530, and a third summing circuit current mirror 540.

The first summing circuit current mirror 520 includes an eighth PMOS transistor 508 and a ninth PMOS transistor 509 coupled in series between the first reference voltage VDD and a seventh node 514. The gate of the eighth PMOS transistor 508 is coupled to the first node 240 and the gate of the ninth PMOS transistor 509 is coupled to the first bias voltage $V_{casp}$. The first summing current mirror 520 provides a mirrored current of the first sub-current $I_1$ to the seventh node 514.

The second summing circuit current mirror 510 comprises a tenth PMOS transistor 510 coupled between the first reference voltage VDD and the seventh node 514. The gate of the tenth PMOS transistor 510 is coupled to the sixth node 416. The second summing current mirror 530 provides a mirrored current of the second sub-current $I_2$ to the seventh node 514.

At the seventh node, the mirrored currents of the first and second sub-currents $I_1$, $I_2$ are combined, or summed, to provide a sum current $I_3$. The sum current $I_3$ is applied to the third summing circuit current mirror 540, which includes a ninth NMOS transistor 511 coupled between the seventh node 514 and the second reference voltage GND, and an tenth NMOS transistor 512 coupled between a bias node 516 and the second reference voltage GND. The gates of the ninth and tenth NMOS transistors 511, 512 are coupled to each other and to the seventh node. The sum current $I_3$ flows through the ninth NMOS transistor 511 and is mirrored at the tenth NMOS transistor 512, which draws the resulting bias current $I_{bias}$ from a circuit connected to the bias node 516.

As mentioned above, the mirrored current of the first sub-current $I_1$ is proportional to temperature, while the mirrored current of the second sub-current $I_2$ is inversely proportional to temperature. Therefore, the summed bias current $I_{bias}$, which is a mirrored current of the sum current $I_3$, can be represented as:

$$I_{bias} = \left[\frac{(W/L)_{508}}{(W/L)_{208}} I_1 + \frac{(W/L)_{510}}{(W/L)_{407}} I_2\right] \cdot \frac{(W/L)_{512}}{(W/L)_{511}} \tag{20}$$

Therefore, by controlling the respective aspect ratios of the transistors 208, 407, 508, 510, 511, and 512, the bias current $I_{bias}$ can be maintained at a constant value that is entirely dependent on the aspect ratios of the transistors and is independent of temperature and process variation. The first sub-current $I_1$ and the second sub-current $I_2$ should be weighted $((W/L)_{508}/(W/L)_{208}$ and $(W/L)_{510}/(W/L)_{407})$ before they are summed, so that the summation is constant with regard to temperature. Also, since different applications require a different bias current, this summation should be amplified or attenuated before it is applied, for example according to $((W/L)_{512}/(W/L)_{511})$. Equation (20) ensures this.

Figure 2:
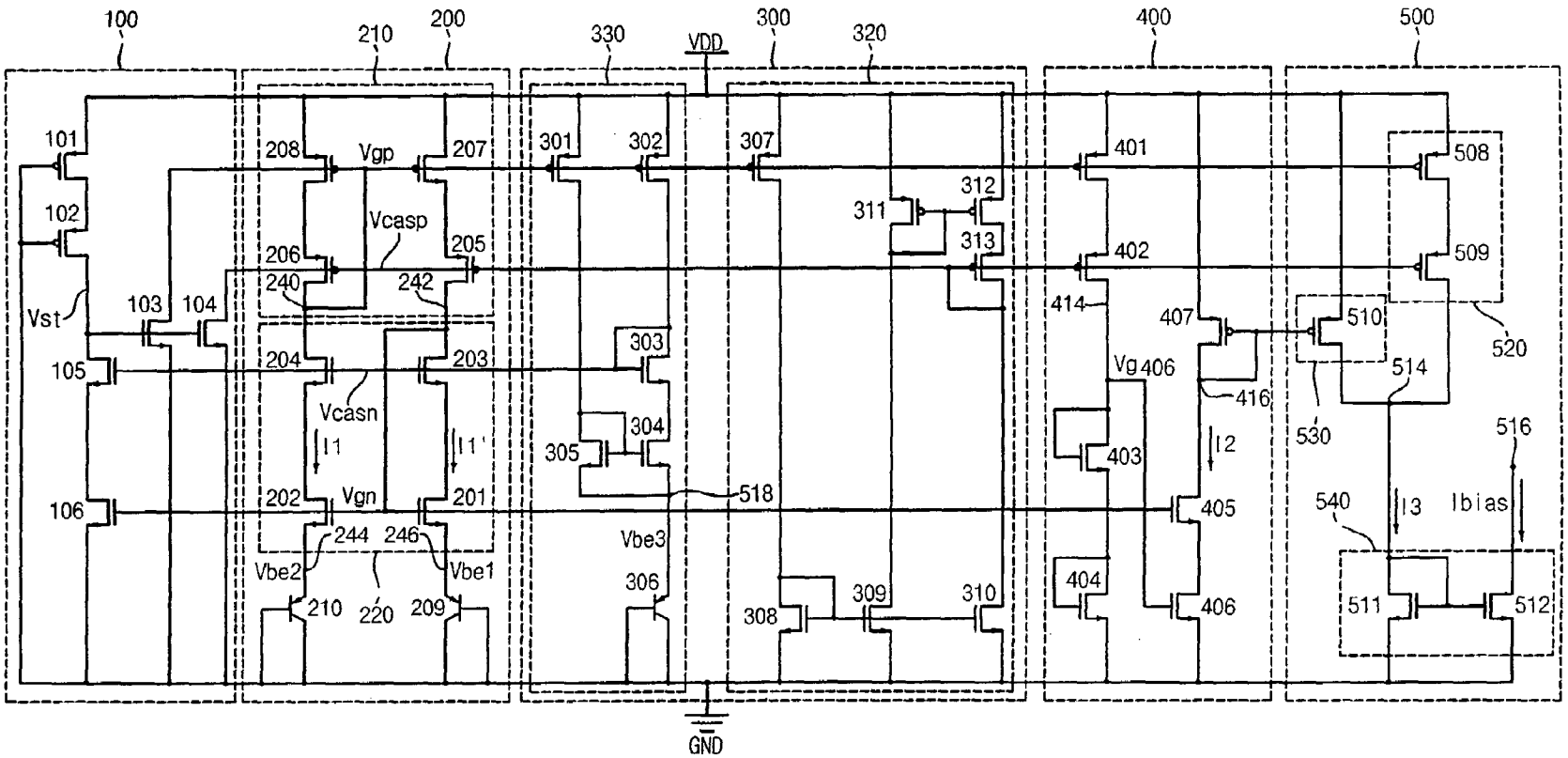
FIG. 2 is a circuit diagram of a second embodiment of a bias current generating circuit in accordance with the present invention.

FIG. 2 is a circuit diagram of a second embodiment of a bias current generating circuit in accordance with the present invention. With reference to FIG. 2, the bias generating circuit includes a proportional-to-absolute-temperature (PTAT) current generator 200, an inverse-proportional-to-absolute-temperature (IPTAT) current generator 400, and a summing circuit 500, as described above, and further includes a bias voltage generator 300 and a start-up circuit 100.

The bias voltage generator 300 includes a first voltage generator 320 and a second voltage generator 330. The first bias voltage generator 320 generates the first bias voltage $V_{casp}$ that is provided to the PMOS cascode current mirror 210 of the PTAT current generator 200. The second bias voltage generator 330 generates the second bias voltage $V_{casn}$ that is provided to the NMOS cascode current mirror 220 of the PTAT current generator 200.

The first bias voltage generator 320 includes an eleventh PMOS transistor 307 and an eleventh NMOS transistor 308 coupled in series between the first reference voltage VDD and the second reference voltage GND. In addition, a twelfth PMOS transistor 311 and a twelfth NMOS transistor 309 are coupled in series between the first reference voltage VDD and the second reference voltage GND. Also, thirteenth and fourteenth PMOS transistors 312, 313 and a thirteenth NMOS transistor 310 are coupled in series between the first reference voltage VDD and the second reference voltage GND. The gate of the eleventh PMOS transistor 307 is coupled to the first node 240. The gate of the eleventh NMOS transistor 308 is coupled to a junction between the eleventh PMOS transistor 307 and the eleventh NMOS transistor 308, and is coupled to gates of the twelfth and thirteenth NMOS transistors 309, 310. The gate of the twelfth PMOS transistor 311 is coupled to a junction between the twelfth PMOS transistor 311 and the twelfth NMOS transistor 309, and is coupled to the gate of the thirteenth PMOS transistor 312. The gate of the fourteenth PMOS transistor 313 is coupled to a junction between the fourteenth PMOS transistor 313 and the thirteenth NMOS transistor 310, and provides the first bias voltage $V_{casp}$ to the startup circuit 100, the PTAT current generator 200 and the IPTAT current generator 400.

The second bias voltage generator 330 includes a fifteenth PMOS transistor 301 and a fifteenth NMOS transistor 305 coupled in series between the first reference voltage VDD and an eighth node 518. In addition, a sixteenth PMOS transistor 302, a fourteenth NMOS transistor 303 and a sixteenth NMOS transistor 304 are coupled in series between the first reference voltage VDD and the eighth node 518. A third PNP-type bipolar junction transistor 306 is coupled in a diode configuration between the eighth node and the second reference voltage GND. The gates of the fifteenth and sixteenth PMOS transistors 301, 302 are coupled to the first node 240. The gate of the fifteenth NMOS transistor 305 is coupled to a junction between the fifteenth PMOS transistor 301 and the fifteenth NMOS transistor 305, and is coupled to a gate of the sixteenth NMOS transistor 304. The gate of the fourteenth NMOS transistor 303 is coupled to a junction between the sixteenth PMOS transistor 302 and the fourteenth NMOS transistor 303, and provides the second bias voltage $V_{casn}$ to the PTAT current generator 200 and the startup circuit 100. The base of the third bipolar junction transistor 306 is coupled to the second reference voltage GND.

The second bias voltage $V_{casn}$ can be determined as follows:

$$V_{casn}=V_{be3}+V_{ds304}+V_{gs303} \tag{21}$$

where $V_{be3}$ is the base-emitter voltage of the third bipolar junction transistor 306, $V_{ds304}$ is the drain-source voltage drop across the sixteenth NMOS transistor 304, and $V_{gs303}$ is the gate-source voltage at the fourteenth NMOS transistor 303.

To generate a suitable voltage for $V_{be3}$, the combination of the currents flowing through the fifteenth and sixteenth PMOS transistors 301 and 302 should, in combination, be p times the current flowing through transistor 207, where p represents the aspect ratio of third bipolar junction transistor 306 to that of the first bipolar junction transistor 209. It is common for p to be chosen as 1, therefore, $$\left(\frac{W}{L}\right)_{301}+\left(\frac{W}{L}\right)_{302}=p\left(\frac{W}{L}\right)_{207} \tag{22}$$

In view of equation (22), to generate a suitable voltage for $V_{ds304}$, it should be maintained that:

$$\left(\frac{W}{L}\right)_{304}+\left(\frac{W}{L}\right)_{305}=p\left(\frac{W}{L}\right)_{201} \text{ and} \tag{23}$$

$$\frac{(W/L)_{304}}{(W/L)_{305}}=\frac{(W/L)_{302}}{(W/L)_{301}} \tag{24}$$

To generate a suitable voltage for $V_{gs303}$, it should be maintained that:

$$\frac{(W/L)_{303}}{(W/L)_{203}}=\frac{(W/L)_{304}}{(W/L)_{201}}=\frac{(W/L)_{302}}{(W/L)_{207}} \tag{25}$$

The first bias voltage $V_{casp}$ can be determined as follows:

$$V_{casp}=VDD+V_{ds312}+V_{gs313}| \tag{26}$$

where $V_{ds312}$ is the drain-source voltage of the thirteenth PMOS transistor 312 and has a negative value, and $V_{gs313}$ is the gate-source voltage of the fourteenth PMOS transistor 313, and has a negative value.

To ensure a suitable value for $V_{ds312}$, and $V_{gs313}$, the sizes of the transistors should be selected such that:

$$\frac{(W/L)_{307}}{(W/L)_{207}}\cdot\frac{(W/L)_{309}}{(W/L)_{308}}\cdot\frac{(W/L)_{312}}{(W/L)_{311}}=\frac{(W/L)_{313}}{(W/L)_{205}} \text{ and} \tag{27}$$

$$\frac{(W/L)_{310}}{(W/L)_{309}}=\frac{(W/L)_{312}}{(W/L)_{311}} \tag{28}$$

in order to ensure that the second, fourth and sixth PMOS transistors 206, 205, 402, operate in the saturation region.

The bias voltage generator 300 of FIG. 2 is an exemplary embodiment of a voltage generator for generating the first and second bias voltages. Other embodiments for generating the first and second bias voltages are equally applicable to the principles of the present invention.

The start-up circuit 100 of FIG. 2 ensures that the PTAT current generator can overcome degenerate bias upon system start-up. Degenerate bias refers to a state in which a transistor fails to conduct current, even though the transistor is in an on state.

The start-up circuit 100 includes seventeenth and a eighteenth PMOS transistors 101, 102 and nineteenth and twentieth NMOS transistors 105, 106 coupled in series between the first reference voltage VDD and the second reference voltage GND. An seventeenth NMOS transistor 103 is coupled between the first node 240 and the second reference voltage GND. An eighteenth NMOS transistor 104 is coupled between the first bias voltage $V_{casp}$ and the second reference voltage GND. Gates of the seventeenth and eighteenth PMOS transistors 101, 102 are coupled to the second reference voltage GND. Gates of the seventeenth and eighteenth NMOS transistors 103, 104 are coupled to a junction between the sixteenth PMOS transistor 102 and the nineteenth NMOS transistor 105. A gate of the nineteenth NMOS transistor 105 is coupled to the second bias voltage $V_{casn}$. A gate of the twentieth NMOS transistor 106 is coupled to the second node 242.

When power is applied to the system, if transistors 204 and 202 carry no current, then transistors 105 and 106 likewise do not carry current. It follows that no current flows through transistors 101 and 102. Therefore, the voltage at the drain node of transistor 105, namely $V_{st}$, must be high, which turns on 103 and 104. In this case, in the start-up circuit, the voltages at the second node $V_{gp}$ and the second bias voltage $V_{casn}$ become low voltages. This, in turn, causes the activation of the first and second PMOS transistors 208, 206 and current is injected into the first and second NMOS transistors 204, 202. This, in turn, raises the voltage levels of the second node $V_{gp}$ and the second bias voltage $V_{casn}$. As a result, transistors 201, 202, 203 and 204 are turned on, and transistors 105 and 106 are likewise turned on. A relatively small aspect ratio (W/L) (1 μm/20 μm) ratio is selected for transistors 101 and 102, such that when transistors 101 and 102 are turned on, the voltage $V_{st}$ is much less than the threshold voltage. Thereafter, when current flows through NMOS transistors 201, 202, 203 and 204, NMOS transistors 103 and 104 are turned off, having no effect on the normal operation of the circuit. In this manner, the circuit is successfully started at power-up in a manner that overcomes degenerate bias.

Figure 3:
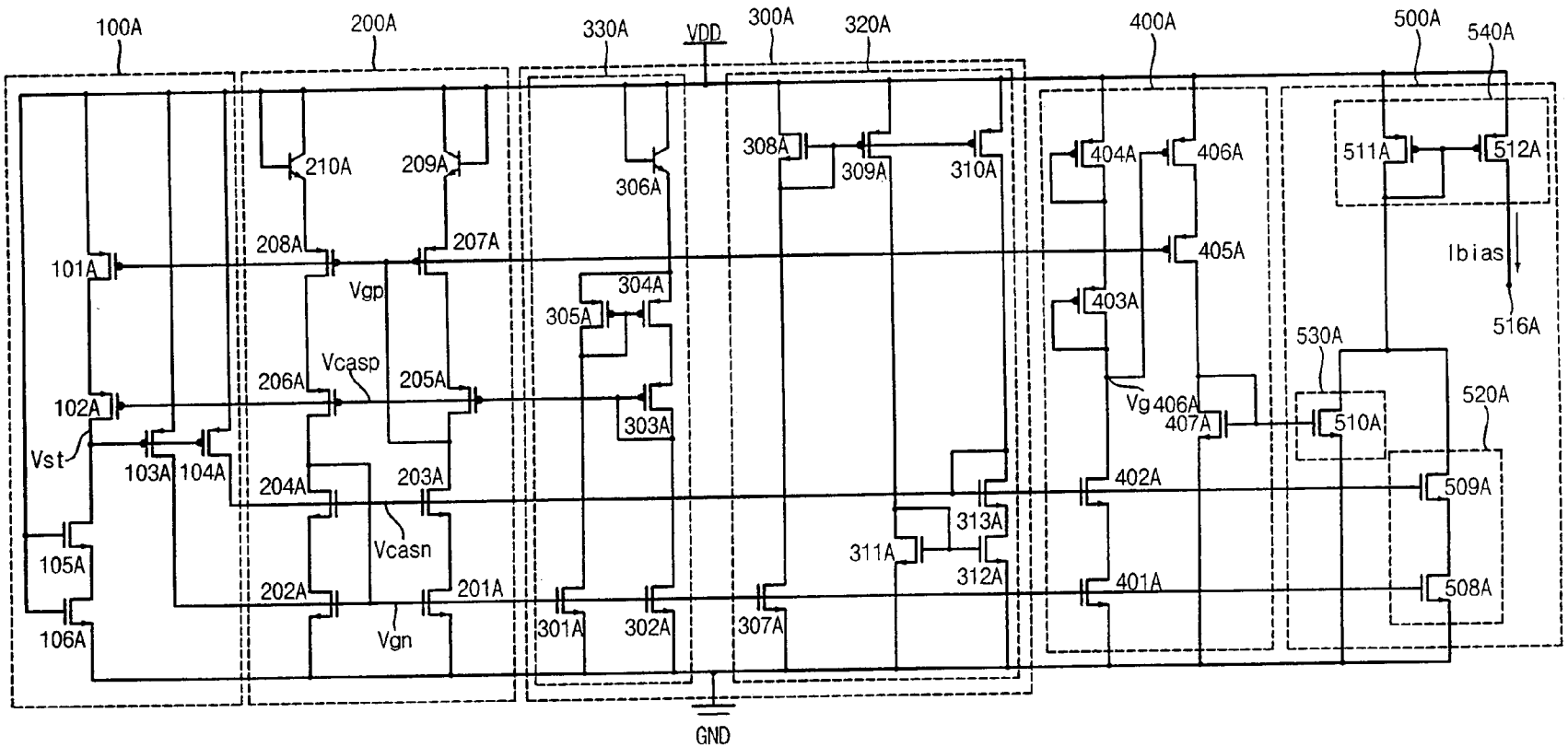
FIG. 3 is a circuit diagram of a third embodiment of a bias current generating circuit in accordance with the present invention.

FIG. 3 is a circuit diagram of a third embodiment of a bias current generating circuit in accordance with the present invention. Like the second embodiment described above, the bias current generating circuit of the third embodiment includes a start-up circuit 100A, a PTAT current generator 200A, a bias voltage generator 300A, an IPTAT current generator 400A and a summing circuit 500A.

In the third embodiment, the purpose and operation of the start-up circuit 100A, the PTAT current generator 200A, the bias voltage generator 300A, the IPTAT current generator 400A and the summing circuit 500A are essentially the same as those equivalent circuits of the first embodiment and second embodiment of FIGS. 1 and 2. However, in the summing circuit 100A, PMOS transistors 103A, 104A are used, instead of the seventeenth and eighteenth NMOS transistors 103, 104. In the PTAT current generator 200A, NPN-type bipolar junction transistors 210A, 209A are positioned in series between the first reference voltage VDD and the PMOS cascode current mirror. In the second bias voltage generator 300A, an NPN-type bipolar junction transistors 306A, PMOS transistors 303A, 304A, 305A and NMOS transistors 301A, 302A are employed. In the first bias voltage generator 320A, PMOS transistors 309A, 310A and NMOS transistors 307A, 308A, 311A, 312*a*, and 313A are used. In the IPTAT current generator 400A, PMOS transistors 403A, 404A, 405A, 406A, and NMOS transistors 401A, 402A are employed. In the summing circuit 500A, the first summing circuit current mirror 520A comprises NMOS transistors 508A, 509A, the second summing circuit current mirror 530A comprises NMOS transistor 510A, and the third summing circuit current mirror 540A comprises PMOS transistors 51A, 512A.

In this manner, the third embodiment of the present invention, like the first and second embodiments above, generates a bias current $I_{bias}$ that is a combination of a first sub-current $I_1$ that is proportional to increased temperature, and a second sub-current $I_2$ that is inversely proportional to increased temperature in a manner that mitigates or eliminates the effects of temperature and process variance.

While this invention has been particularly shown and described with references to preferred embodiments, thereof, it will be understood by those skilled in the art that various changes in form and details may be made herein without departing from the spirit and scope of the invention as defined by the appended claims.

What is claimed is:

1. A bias current generator comprising:

a proportional-to-absolute-temperature (PTAT) current generator comprising exclusively active circuit elements that generates a first current that is proportional to operating temperature;

an inverse-proportional-to-absolute-temperature (IPTAT) current generator comprising exclusively active circuit elements that generates a second current that is inversely proportional to the operating temperature; and a summing circuit that sums the first and second currents to generate a bias current.

2. The bias current generator of claim 1 wherein the bias current is generated substantially independent of the operating temperature.

3. The bias current generator of claim 1 wherein the PTAT current generator comprises:

a PMOS cascode current mirror comprising:

a first PMOS transistor and a second PMOS transistor connected in series between a first reference voltage and a first node, a gate of the first PMOS transistor being coupled to the first node and a gate of the second PMOS transistor being coupled to a first bias voltage; and a third PMOS transistor and a fourth PMOS transistor connected in series between the first reference voltage and a second node, a gate of the third PMOS transistor being coupled to the first node and a gate of the fourth PMOS transistor being coupled to the first bias voltage;

an NMOS cascode current mirror comprising:

a first NMOS transistor and a second NMOS transistor connected in series between the first node and a third node, a gate of the first NMOS transistor being coupled to a second bias voltage and a gate of the second NMOS transistor being coupled to the second node; and a third NMOS transistor and a fourth NMOS transistor connected in series between the second node and a fourth node, a gate of the third NMOS transistor being coupled to the second bias voltage and a gate of the fourth NMOS transistor being coupled to the second node;

a first diode connected in series between the third node and a second reference voltage; and a second diode connected in series between the fourth node and the second reference voltage.

4. The bias current generator of claim 3 wherein the first reference voltage comprises a power supply voltage and wherein the second reference voltage comprises a ground voltage.

5. The bias current generator of claim 3 wherein the first diode comprises a PNP-type bipolar junction transistor, an emitter of which is connected to the third node and a base and collector of which are connected to the second reference voltage and wherein the second diode comprises a PNP-type bipolar junction transistor, an emitter of which is connected to the fourth node and a base and collector of which are connected to the second reference voltage.

6. The bias current generator of claim 3 wherein the first bias voltage is at a voltage level that is sufficient to saturate the second and fourth PMOS transistors, and wherein the second bias voltage is at a voltage level that is sufficient to saturate the first and third NMOS transistors.

7. The bias current generator of claim 3 wherein the IPTAT current generator comprises:

a fifth PMOS transistor and a sixth PMOS transistor connected in series between the first reference voltage and a fifth node, a gate of the fifth PMOS transistor being coupled to the first node and a gate of the sixth PMOS transistor being coupled to the first bias voltage; and a fifth NMOS transistor and a sixth NMOS transistor connected in series between the fifth node and the second reference voltage, the fifth and sixth NMOS transistors each being configured in a diode configuration;

a seventh PMOS transistor connected between the first reference voltage and a sixth node, the gate of the seventh PMOS transistor being coupled to the sixth node; and a seventh NMOS transistor and an eighth NMOS transistor connected in series between the sixth node and the second reference voltage, a gate of the seventh NMOS transistor being coupled to the second node, and a gate of the eighth NMOS transistor being coupled to the fifth node.

8. The bias current generator of claim 7 wherein the summing circuit comprises an eighth PMOS transistor and a ninth PMOS transistor connected in series between the first reference voltage and a seventh node, a gate of the eighth PMOS transistor being coupled to the first node and a gate of the ninth PMOS transistor being coupled to the first bias voltage;

a tenth PMOS transistor connected between the first reference voltage and the seventh node, a gate of the tenth PMOS transistor being coupled to the sixth node;

a ninth NMOS transistor connected between the seventh node and the second reference voltage, the gate of the ninth NMOS transistor being coupled to the seventh node; and a tenth NMOS transistor connected between a bias node at which the bias current is drawn and the second reference voltage, the gate of the tenth NMOS transistor being coupled to the seventh node.

9. The bias current generator of claim 3 further comprising a bias voltage generator including a first bias voltage generator that generates the first bias voltage and a second bias voltage generator that generates the second bias voltage, the first bias voltage generator comprising:

an eleventh PMOS transistor and an eleventh NMOS transistor in series between the first reference voltage and the second reference voltage, the gate of the eleventh PMOS transistor being coupled to the first node, the gate of the eleventh NMOS transistor being coupled to a junction between the eleventh PMOS transistor and the eleventh NMOS transistor;

a twelfth PMOS transistor and a twelfth NMOS transistor in series between the first reference voltage and the second reference voltage, the gate of the twelfth PMOS transistor being coupled to a junction between the twelfth PMOS transistor and the twelfth NMOS transistor, the gate of the twelfth NMOS transistor being coupled to the gate of the eleventh NMOS transistor; and a thirteenth PMOS transistor, a fourteenth PMOS transistor and a thirteenth NMOS transistor in series between the first reference voltage and the second reference voltage, the gate of the thirteenth PMOS transistor being coupled to the gate of the twelfth PMOS transistor, the gate of the fourteenth PMOS transistor being coupled to a junction between the fourteenth PMOS transistor and the thirteenth NMOS transistor, the gate of the thirteenth NMOS transistor being coupled to the gate of the twelfth NMOS transistor, wherein the junction of the fourteenth PMOS transistor and the thirteenth NMOS transistor provides the first bias voltage; and the second bias voltage generator comprising:

a fifteenth PMOS transistor and a fifteenth NMOS transistor in series between the first reference voltage and an eighth node, the gate of the fifteenth PMOS transistor being coupled to the first node, the gate of the fifteenth NMOS transistor being coupled to a junction between the fifteenth PMOS transistor and the fifteenth NMOS transistor;

a sixteenth PMOS transistor, a fourteenth NMOS transistor and a sixteenth NMOS transistor in series between the first reference voltage and the eighth node, the gate of the sixteenth PMOS transistor being coupled to the first node, the gate of the fourteenth NMOS transistor being coupled to a junction between the sixteenth PMOS transistor and the fourteenth NMOS transistor, the gate of the sixteenth NMOS transistor being coupled to the gate of the fifteenth NMOS transistor; and a third diode connected in series between the eighth node and the second reference voltage, wherein the junction of the sixteenth PMOS transistor and the fourteenth NMOS transistor provides the second bias voltage.

10. The bias current generator of claim 9 wherein the third diode comprises a PNP-type bipolar junction transistor, an emitter of which is connected to the eighth node and a base and collector of which are connected to the second reference voltage.

11. The bias current generator of claim 3 further comprising a start-up circuit that ensures that transistors in the PTAT current generator and the IPTAT current generator initialize beyond a degenerate bias.

12. The bias current generator of claim 11 wherein the start-up circuit comprises:

a seventeenth PMOS transistor, an eighteenth PMOS transistor, a nineteenth NMOS transistor and a twentieth NMOS transistor connected in series between the first reference voltage and the second reference voltage, gates of the seventeenth and eighteenth PMOS transistors each being coupled to the second reference voltage, a gate of the nineteenth NMOS transistor being coupled to the second bias voltage and a gate of the twentieth NMOS transistor being coupled to the second node;

a seventeenth NMOS transistor connected in series between the first node and the second reference voltage; and an eighteenth NMOS transistor connected in series between the first bias voltage and the second reference voltage.

13. The bias current generator of claim 1 wherein the summing circuit comprises:

a first current mirror that generates a first mirrored current in response to the first current generated by the PTAT;

a second current mirror that generates a second mirrored current in response to the second current generated by the PTAT; and a third current mirror that generates the bias current based on the sum of the first mirrored current and the second mirrored current.

14. The bias current generator of claim 1 wherein the first current is generated further as a function of a first aspect ratio of at least one transistor along a first current path relative to a second aspect ratio of at least one transistor along a second current path, the second current path and first current path being in a current mirror configuration, the first and second aspect ratios for corresponding transistors in the first and second current paths being different.

15. The bias current generator of claim 14 wherein the second current is generated further as a function of a voltage generated in the PTAT current generator that is divided by an active circuit element in the IPTAT current generator to generate the second current.

16. The bias current generator of claim 1 wherein the PTAT current generator comprises:

a first current path comprising a plurality of transistors; and a second current path comprising a plurality of transistors, at least one of the plurality of transistors of the second current path corresponding to one of the plurality of transistors of the first current path, at least one pair of the corresponding transistors of the first and second current paths having a different aspect ratio, wherein the first current is generated in response to the different aspect ratio of the corresponding transistors of the first and second current paths.

17. The bias current generator of claim 16 wherein the IPTAT current generator comprises a third current path comprising a plurality of transistors, wherein the second current is generated further as a function of a voltage generated in the PTAT current generator that is divided by a transistor in the third current path to generate the second current.

18. The bias current generator of claim 1 wherein the PTAT current generator comprises:

a first diode connected in series between a first reference voltage and a third node;

a second diode connected in series between the first reference voltage and a fourth node;

a PMOS cascode current mirror comprising:

a first PMOS transistor and a second PMOS transistor connected in series between the third node and a first node, and a third PMOS transistor and a fourth PMOS transistor connected in series between the fourth node and a second node, gates of the first and third PMOS transistors being coupled to the second node, and gates of the second and fourth PMOS transistors being coupled to a first bias voltage; and an NMOS cascode current mirror comprising:

a first NMOS transistor and a second NMOS transistor connected in series between the first node and a second reference voltage, and a third NMOS transistor and a fourth NMOS transistor connected in series between the second node and the second reference voltage, gates of the first and third NMOS transistors being coupled to a second bias voltage, and gates of the second and fourth NMOS transistors being coupled to the first node.

19. The bias current generator of claim 18 wherein the first reference voltage comprises a power supply voltage and wherein the second reference voltage comprises a ground voltage.

20. The bias current generator of claim 18 wherein the first diode comprises an NPN-type bipolar junction transistor, an emitter of which is connected to the third node and a base and collector of which are connected to the first reference voltage and wherein the second diode comprises an NPN-type bipolar junction transistor, an emitter of which is connected to the fourth node and a base and collector of which are connected to the first reference voltage.

21. The bias current generator of claim 18 wherein the first bias voltage is at a voltage level that is sufficient to saturate the second and fourth PMOS transistors, and wherein the second bias voltage is at a voltage level that is sufficient to saturate the first and third NMOS transistors.

22. The bias current generator of claim 18 wherein the IPTAT current generator comprises:

a fifth PMOS transistor and a sixth PMOS transistor connected in series between the first reference voltage and a fifth node, the fifth and sixth PMOS transistors each being configured in a diode configuration;

a fifth NMOS transistor and a sixth NMOS transistor connected in series between the fifth node and the second reference voltage, a gate of the fifth NMOS transistor being coupled to the second bias voltage and a gate of the sixth NMOS transistor being coupled to the first node;

a seventh PMOS transistor and an eighth PMOS transistor connected in series between the first reference voltage and a sixth node, a gate of the seventh PMOS transistor being coupled to the fifth node, and a gate of the eighth PMOS transistor being coupled to the second node; and a seventh NMOS transistor connected between the sixth node and the second reference voltage, the gate of the seventh NMOS transistor being coupled to the sixth node.

23. The bias current generator of claim 22 wherein the summing circuit comprises:

an eighth NMOS transistor and a ninth NMOS transistor connected in series between a seventh node and the second reference voltage, a gate of the eighth NMOS transistor being coupled to the second bias voltage and a gate of the ninth NMOS transistor being coupled to the first node;

a tenth NMOS transistor connected between the seventh node and the second reference voltage, a gate of the tenth NMOS transistor being coupled to the sixth node;

a ninth PMOS transistor connected between the first reference voltage and the seventh node, the gate of the ninth PMOS transistor being coupled to the seventh node; and a tenth PMOS transistor connected between the first reference voltage and a bias node at which the bias current is drawn, the gate of the tenth NMOS transistor being coupled to the seventh node.

24. A bias current generator comprising:

a proportional-to-absolute-temperature (PTAT) current generator that generates a first current that is proportional to operating temperature comprising: a first current path comprising a plurality of transistors; and a second current path comprising a plurality of transistors, at least one of the plurality of transistors of the second current path corresponding to one of the plurality of transistors of the first current path, at least one pair of the corresponding transistors of the first and second current paths having a different aspect ratio, wherein the first current is generated in response to the different aspect ratio of the corresponding transistors of the first and second current paths;

an inverse-proportional-to-absolute-temperature (IPTAT) current generator that generates a second current that is inversely proportional to the operating temperature comprising a third current path comprising a plurality of transistors, wherein the second current is generated as a function of a voltage generated in the PTAT current generator that is divided by a transistor in the third current path to generate the second current; and a summing circuit that sums the first and second currents to generate a bias current.

25. The bias current generator of claim 24 wherein the PTAT current generator comprises exclusively active circuit elements.

26. The bias current generator of claim 24 wherein the IPTAT current generator comprises exclusively active circuit elements.

27. The bias current generator of claim 24 wherein the bias current is generated substantially independent of the operating temperature.

28. The bias current generator of claim 24 wherein the PTAT current generator comprises:

a PMOS cascode current mirror comprising:

a first PMOS transistor and a second PMOS transistor connected in series between a first reference voltage and a first node, a gate of the first PMOS transistor being coupled to the first node and a gate of the second PMOS transistor being coupled to a first bias voltage; and a third PMOS transistor and a fourth PMOS transistor connected in series between the first reference voltage and a second node, a gate of the third PMOS transistor being coupled to the first node and a gate of the fourth PMOS transistor being coupled to the first bias voltage;

an NMOS cascode current mirror comprising:

a first NMOS transistor and a second NMOS transistor connected in series between the first node and a third node, a gate of the first NMOS transistor being coupled to a second bias voltage and a gate of the second NMOS transistor being coupled to the second node; and a third NMOS transistor and a fourth NMOS transistor connected in series between the second node and a fourth node, a gate of the third NMOS transistor being coupled to the second bias voltage and a gate of the fourth NMOS transistor being coupled to the second node;

a first diode connected in series between the third node and a second reference voltage; and a second diode connected in series between the fourth node and the second reference voltage.

29. The bias current generator of claim 28 wherein the first reference voltage comprises a power supply voltage and wherein the second reference voltage comprises a ground voltage.

30. The bias current generator of claim 28 wherein the first diode comprises a PNP-type bipolar junction transistor, an emitter of which is connected to the third node and a base and collector of which are connected to the second reference voltage and wherein the second diode comprises a PNP-type bipolar junction transistor, an emitter of which is connected to the fourth node and a base and collector of which are connected to the second reference voltage.

31. The bias current generator of claim 28 wherein the first bias voltage is at a voltage level that is sufficient to saturate the second and fourth PMOS transistors, and wherein the second bias voltage is at a voltage level that is sufficient to saturate the first and third NMOS transistors.

32. The bias current generator of claim 28 wherein the IPTAT current generator comprises:

a fifth PMOS transistor and a sixth PMOS transistor connected in series between the first reference voltage and a fifth node, a gate of the fifth PMOS transistor being coupled to the first node and a gate of the sixth PMOS transistor being coupled to the first bias voltage; and a fifth NMOS transistor and a sixth NMOS transistor connected in series between the fifth node and the second reference voltage, the fifth and sixth NMOS transistors each being configured in a diode configuration;

a seventh PMOS transistor connected between the first reference voltage and a sixth node, the gate of the seventh PMOS transistor being coupled to the sixth node; and a seventh NMOS transistor and an eighth NMOS transistor connected in series between the sixth node and the second reference voltage, a gate of the seventh NMOS transistor being coupled to the second node, and a gate of the eighth NMOS transistor being coupled to the fifth node.

33. The bias current generator of claim 32 wherein the summing circuit comprises an eighth PMOS transistor and a ninth PMOS transistor connected in series between the first reference voltage and a seventh node, a gate of the eighth PMOS transistor being coupled to the first node and a gate of the ninth PMOS transistor being coupled to the first bias voltage; and a tenth PMOS transistor connected between the first reference voltage and the seventh node, a gate of the tenth PMOS transistor being coupled to the sixth node;

a ninth NMOS transistor connected between the seventh node and the second reference voltage, the gate of the ninth NMOS transistor being coupled to the seventh node; and a tenth NMOS transistor connected between a bias node at which the bias current is drawn and the second reference voltage, the gate of the tenth NMOS transistor being coupled to the seventh node.

34. The bias current generator of claim 28 further comprising a bias voltage generator including a first bias voltage generator that generates the first bias voltage and a second bias voltage generator that generates the second bias voltage, the first bias voltage generator comprising:

an eleventh PMOS transistor and an eleventh NMOS transistor in series between the first reference voltage and the second reference voltage, the gate of the eleventh PMOS transistor being coupled to the first node, the gate of the eleventh NMOS transistor being coupled to a junction between the eleventh PMOS transistor and the eleventh NMOS transistor;

an twelfth PMOS transistor and a twelfth NMOS transistor in series between the first reference voltage and the second reference voltage, the gate of the twelfth PMOS transistor being coupled to a junction between the twelfth PMOS transistor and the twelfth NMOS transistor, the gate of the twelfth NMOS transistor being coupled to the gate of the eleventh NMOS transistor; and a thirteenth PMOS transistor, a fourteenth PMOS transistor and a thirteenth NMOS transistor in series between the first reference voltage and the second reference voltage, the gate of the thirteenth PMOS transistor being coupled to the gate of the twelfth PMOS transistor, the gate of the fourteenth PMOS transistor being coupled to a junction between the fourteenth PMOS transistor and the thirteenth NMOS transistor, the gate of the thirteenth NMOS transistor being coupled to the gate of the twelfth NMOS transistor, wherein the junction of the fourteenth PMOS transistor and the thirteenth NMOS transistor provides the first bias voltage; and the second bias voltage generator comprising:

a fifteenth PMOS transistor and a fifteenth NMOS transistor in series between the first reference voltage and an eighth node, the gate of the fifteenth PMOS transistor being coupled to the first node, the gate of the fifteenth NMOS transistor being coupled to a junction between the fifteenth PMOS transistor and the fifteenth NMOS transistor;

a sixteenth PMOS transistor, a fourteenth NMOS transistor and a sixteenth NMOS transistor in series between the first reference voltage and the eighth node, the gate of the sixteenth PMOS transistor being coupled to the first node, the gate of the fourteenth NMOS transistor being coupled to a junction between the sixteenth PMOS transistor and the fourteenth NMOS transistor, the gate of the sixteenth NMOS transistor being coupled to the gate of the fifteenth NMOS transistor; and a third diode connected in series between the eighth node and the second reference voltage, wherein the junction of the sixteenth PMOS transistor and the fourteenth NMOS transistor provides the second bias voltage.

35. The bias current generator of claim 34 wherein the third diode comprises a PNP-type bipolar junction transistor, an emitter of which is connected to the eighth node and a base and collector of which are connected to the second reference voltage.

36. The bias current generator of claim 28 further comprising a start-up circuit that ensures that transistors in the PTAT current generator and the IPTAT current generator initialize beyond a degenerate bias.

37. The bias current generator of claim 24 wherein the start-up circuit comprises:

a seventeenth PMOS transistor, an eighteenth PMOS transistor, a nineteenth NMOS transistor and a twentieth NMOS transistor connected in series between the first reference voltage and the second reference voltage, gates of the seventeenth and eighteenth PMOS transistors each being coupled to the second reference voltage, a gate of the nineteenth NMOS transistor being coupled to the second bias voltage and a gate of the twentieth NMOS transistor being coupled to the second node;

a seventeenth NMOS transistor connected in series between the first node and the second reference voltage; and an eighteenth NMOS transistor connected in series between the first bias voltage and the second reference voltage.

38. The bias current generator of claim 24 wherein the summing circuit comprises:

a first current mirror that generates a first mirrored current in response to the first current generated by the PTAT;

a second current mirror that generates a second mirrored current in response to the second current generated by the PTAT; and a third current mirror that generates the bias current based on the sum of the first mirrored current and the second mirrored current.

39. The bias current generator of claim 24 wherein the PTAT current generator comprises:

a first current path comprising a plurality of transistors; and a second current path comprising a plurality of transistors, at least one of the plurality of transistors of the second current path corresponding to one of the plurality of transistors of the first current path, at least one pair of the corresponding transistors of the first and second current paths having a different aspect ratio, wherein the first current is generated in response to the different aspect ratio of the corresponding transistors of the first and second current paths.

40. The bias current generator of claim 39 wherein the IPTAT current generator comprises a third current path comprising a plurality of transistors, wherein the second current is generated as a function of a voltage generated in the PTAT current generator that is divided by an active circuit element in the IPTAT current generator to generate the second current.

41. The bias current generator of claim 24 wherein the PTAT current generator comprises:

a first diode connected in series between a first reference voltage and a third node;

a second diode connected in series between the first reference voltage and a fourth node;

a PMOS cascode current mirror comprising:

a first PMOS transistor and a second PMOS transistor connected in series between the third node and a first node, and a third PMOS transistor and a fourth PMOS transistor connected in series between the fourth node and a second node, gates of the first and third PMOS transistors being coupled to the second node, and gates of the second and fourth PMOS transistors being coupled to a first bias voltage; and an NMOS cascode current mirror comprising:

a first NMOS transistor and a second NMOS transistor connected in series between the first node and a second reference voltage, and a third NMOS transistor and a fourth NMOS transistor connected in series between the second node and the second reference voltage, gates of the first and third NMOS transistors being coupled to a second bias voltage, and gates of the second and fourth NMOS transistors being coupled to the first node.

42. The bias current generator of claim 41 wherein the first reference voltage comprises a power supply voltage and wherein the second reference voltage comprises a ground voltage.

43. The bias current generator of claim 41 wherein the first diode comprises an NPN-type bipolar junction transistor, an emitter of which is connected to the third node and a base and collector of which are connected to the first reference voltage and wherein the second diode comprises an NPN-type bipolar junction transistor, an emitter of which is connected to the fourth node and a base and collector of which are connected to the first reference voltage.

44. The bias current generator of claim 41 wherein the first bias voltage is at a voltage level that is sufficient to saturate the second and fourth PMOS transistors, and wherein the second bias voltage is at a voltage level that is sufficient to saturate the first and third NMOS transistors.

45. The bias current generator of claim 41 wherein the IPTAT current generator comprises:

a fifth PMOS transistor and a sixth PMOS transistor connected in series between the first reference voltage and a fifth node, the fifth and sixth PMOS transistors each being configured in a diode configuration; and a fifth NMOS transistor and a sixth NMOS transistor connected in series between the fifth node and the second reference voltage, a gate of the fifth NMOS transistor being coupled to the second bias voltage and a gate of the sixth NMOS transistor being coupled to the first node;

a seventh PMOS transistor and an eighth PMOS transistor connected in series between the first reference voltage and a sixth node, a gate of the seventh PMOS transistor being coupled to the fifth node, and a gate of the eighth PMOS transistor being coupled to the second node; and a seventh NMOS transistor connected between the sixth node and the second reference voltage, the gate of the seventh NMOS transistor being coupled to the sixth node.

46. The bias current generator of claim 45 wherein the summing circuit comprises an eighth NMOS transistor and a ninth NMOS transistor connected in series between a seventh node and the second reference voltage, a gate of the eighth NMOS transistor being coupled to the second bias voltage and a gate of the ninth NMOS transistor being coupled to the first node;

a tenth NMOS transistor connected between the seventh node and the second reference voltage, a gate of the tenth NMOS transistor being coupled to the sixth node; and a ninth PMOS transistor connected between the first reference voltage and the seventh node, the gate of the ninth PMOS transistor being coupled to the seventh node; and a tenth PMOS transistor connected between the first reference voltage and a bias node at which the bias current is drawn, the gate of the tenth NMOS transistor being coupled to the seventh node.

* * * * *